United States Patent [19]

Klemets

[11] Patent Number: 4,947,990

[45] Date of Patent: Aug. 14, 1990

[54] PACKAGE OF ABRASIVE MATERIALS

[75] Inventor: Ronny Klemets, Jeppo, Finland

[73] Assignee: KWH Mirka Ltd., Jeppo, Finland

[21] Appl. No.: 360,892

[22] PCT Filed: Dec. 10, 1987

[86] PCT No.: PCT/FI87/00165

§ 371 Date: May 25, 1989

§ 102(e) Date: May 25, 1989

[87] PCT Pub. No.: WO88/04265

PCT Pub. Date: Jun. 16, 1988

[30] Foreign Application Priority Data

Dec. 10, 1986 [FI] Finland ..... 865039

[51] Int. Cl.[5] ..... B65D 85/67

[52] U.S. Cl. ..... 206/409; 206/412; 206/445; 221/305

[58] Field of Search ..... 206/445, 409, 411, 412, 206/395, 494; 221/70, 71, 72, 73, 74, 305

[56] References Cited

U.S. PATENT DOCUMENTS

| | | | |
|---|---|---|---|
| 1,937,960 | 12/1933 | Hummel | 221/305 |
| 3,267,623 | 8/1966 | Block | 206/445 |
| 3,674,176 | 7/1972 | Sagi | 221/70 |
| 4,294,357 | 10/1981 | Stevens et al. | 206/445 |
| 4,298,158 | 11/1981 | Hoppe et al. | 221/73 |
| 4,387,831 | 6/1983 | McNally | 221/70 |

FOREIGN PATENT DOCUMENTS

| | | |
|---|---|---|
| 2926340 | 5/1981 | Fed. Rep. of Germany . |
| 1497355 | 1/1978 | United Kingdom . |

*Primary Examiner*—Paul T. Sewell
*Assistant Examiner*—Jacob K. Ackun, Jr.
*Attorney, Agent, or Firm*—McGlew & Tuttle

[57] ABSTRACT

Package of preferably self-adhesive abrasive material (1), comprising circular disks or sheets, which are attached to each other to make a connected unit, which is folded together to make a bundle (3) so that all the abrasive material sheets or disks (1) in the bundle (3) are placed so that their face (1*a*) provided with abrasive material is facing upwards. The invention is characterized in that the abrasive material sheets or discs (1) are attached to each other by means of a continuous carrying band (2) passed along one side of the bundle (3) and in loops in between each sheet or disc of abrasive material (1), the upper portion (2*a*) of each loop being fixed to the side (1*b*) free of abrasive material of the sheet or disk of abrasive material (1) placed above, and the lower portion (2*b*) of each loop lying free between the upper portion (2*a*) of the loop and the abrasive-material-coated face (1*a*) of the sheet or disc of abrasive material placed underneath.

5 Claims, 2 Drawing Sheets

PACKAGE OF ABRASIVE MATERIALS

FIELD OF THE INVENTION

The present invention concerns a package of preferably self-adhesive abrasive material such as circular disks or sheets arranged to a bundle with an abrasive-coated face of each sheet or disk of the abrasive material facing upwards, said sheets or disks of the abrasive material being attached to each others by means of a continuous carrying band passing along one side of the bundle and in loops in between each sheet or disk of the abrasive material, the upper portion of each loop being fixed to the abrasive-free side of the sheet or disk of abrasive material positioned above said loop, and the lower portion of each loop lying free between the upper portion of said loop and the abrasive-coated face of the sheet or disk of abrasive material positioned underneath, the bundle being inserted in a closed box having a dispenser opening at its top, at the proximity of and substantially parallel to a side edge.

BACKGROUND OF THE INVENTION

In the prior-art abrasive material packages such as disclosed in the German Patent Application No. 2 926 340, all abrasive disks are provided with a protective covering on their adhesive-coated side and are joined into a connected unit by means of separate adhesive-coated carrying bands, whereat each band is attached to the protective coverings of two adjoining abrasive disks. In the embodiment in which the abrasive disks are arranged in a bundle with their abrasive-coated faces facing in the same direction, each carrying band is folded in Z-form, whereat the length of the free portion of the carrying band equals the diameter of the disk. The bundle is inserted into a dispenser box with the abrasive-coated faces facing downwards. The dispensing of a disk is carried out with the lid of the dispenser in an opened position, whereby the carrying bands and the protective coverings are removed from the rigid abrasive disks when a carrying band is drawn around the front edge of the lid. The dust protection properties of such a dispenser are very negligible.

From the British Patent Specification 1 497 355 a method of storing and subsequently separating flat objects as well as a device for carrying out the method is known. The flat objects are stored substantially as disclosed in the introduction part of this specification. The dispenser opening of this prior-art device is positioned in the upper portion of a vertical side wall having no means to prevent more than one flat object to be dispensed simultaneously through the dispener opening. If self-adhesive abrasive disks or sheets were stored in such a device there would be no guarantie that only one disk or sheet were dispensed simultaneously through the dispenser opening.

SUMMARY AND OBJECT OF THE INVENTION

The object of the present invention is to eliminate the above mentioned problems. This has been achieved by means of a package which is characterized in that the box in or just below the dispenser opening is provided with a substantially horizontal edge portion projecting inwardly from a vertical side wall of the box adjacent to the carrying band of the bundle, which edge portion prevents more than the uppermost abrasive material in the bundle to be dispensed at the same time.

In the following, the invention will be described in more detail with reference to the accompanying drawing, wherein

DESCRIPTION OF THE PREFERRED EMBODIMENT

Figure 1:
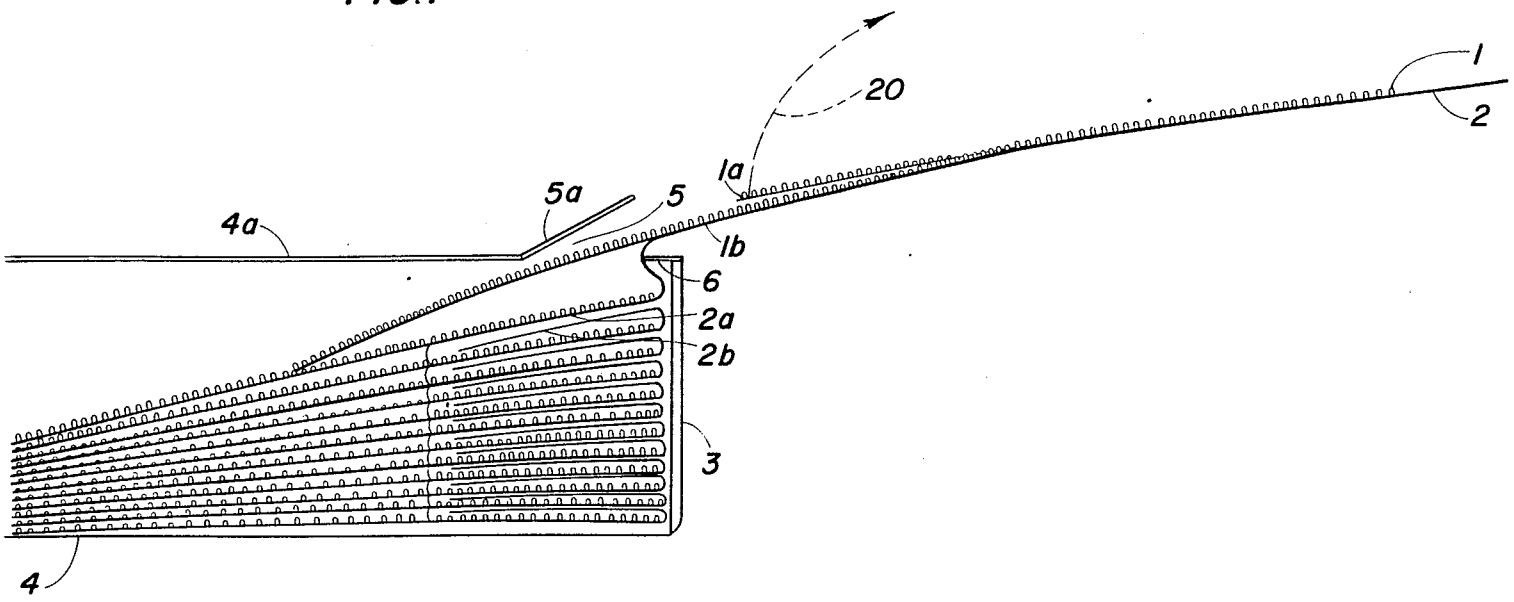
FIG. 1 is a sectional side view of an example of a package in accordance with the invention.
Figure 2:
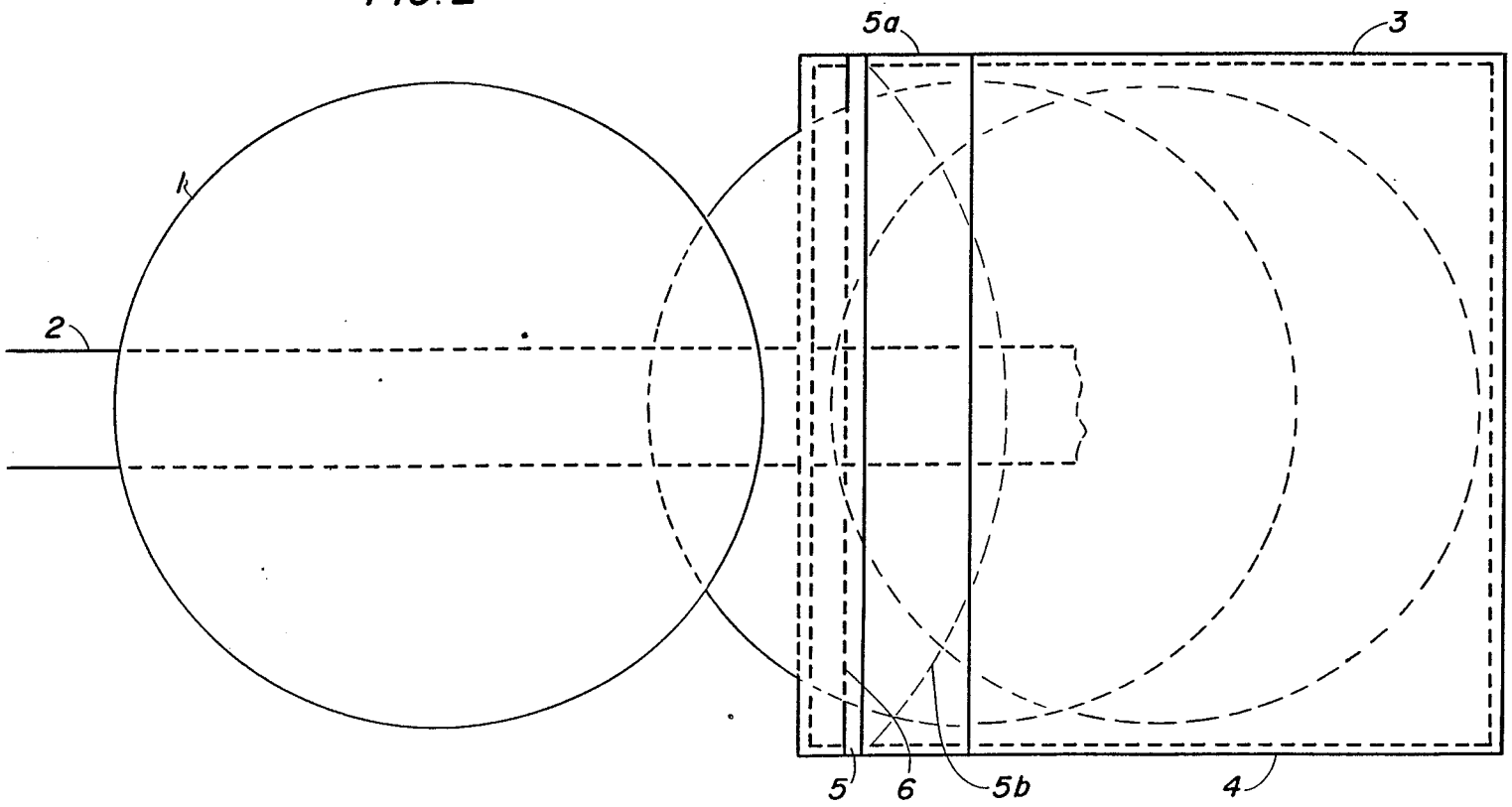
FIG. 2 is a top view of the package.

According to the invention, the abrasive material 1, in particular self-adhesive abrasive disks or sheets, is attached to a continuous carrying band 2 so that a connected unit is formed, said unit comprising a series of abrasive material pieces 1 following one after the other and possibly slightly overlapping each other. The connected unit is folded together to make a bundle 3 so that all the sheets or disks of abrasive material 1 in the bundle 3 are placed so that their side 1*a* provided with the abrasive material is facing upwards. When the sheets or disks of abrasive material 1 are arranged in the bundle 3, they remain plane, which facilitates the use of the abrasive material 1 considerably. The carrying band 2 is passed as loops between each sheet or disc of abrasive material 1 at one side of the bundle 3. The upper portion 2*a* of each loop is attached to the lower side 1*b*, free of abrasive material, of the sheet or disk of abrasive material 1 placed above, and the lower portion 2*b* of each loop lies free between the upper portion 2*a* of the loop and the side 1*a*, provided with abrasive material, of the sheet or disk of abrasive material 1 placed below.

If self-adhesive abrasive material 1 is concerned, which is the commonest type on the market, the carrying band 2 is completely free from adhesive, and the attaching of the sheets or disks of abrasive material 1 to the carrying band 2 takes place by means of the self-adhesive glue which has been applied to the side 1*b* of the sheet or disk of abrasive material 1 free from the abrasive material. When non-self-adhesive abrasive material 1 is packaged, which was the commonest type in use earlier, on the contrary, one side of the carrying band 2 must be provided with a self-adhesive glue layer.

By varying the lengths of the carrying-band 2 loops between the sheets or discs of abrasive material 1, it is possible to vary the degree of overlapping of the individual abrasive material pieces 1 in the connected unit at dispensing. If no overlapping is desired, the total length of the upper portion 2*a* and the lower portion 2*b* of a loop must be at least equal to the length of the sheet or disk of abrasive material 1 in the direction of the carrying band 2.

According to the preferred embodiment, the carrying band 2 consists of a carrying band of siliconized paper, plastic film, or similar material, but in certain cases, a carrying band 2 in the form of a thread or cord may also be concerned.

In order to obtain a dust protection of maximum efficiency, in particular for self-adhesive abrasive material 1 without using a protective covering for each individual sheet or disk of abrasive material 1, it is advantageous to place the formed bundle 3 in a closed box 4, which is, at the top, preferably at the proximity of a side edge, provided with a dispenser opening 5. The box 4 may be provided either with a removable lid 4*a*, in which the dispenser opening 5 is provided according to one embodiment, or it may be provided with completely fixed side walls. As a result of the way in which the bundle 3 is formed, the dispensing of the abrasive material 1 out of the box takes place extremely easily. As the carrying band 2 runs as loops along one side of the bundle 3, each abrasive material sheet or disk is positioned correctly right in the bundle 3 inside the box 4 and does not have to be turned or bent.

According to the simplest embodiment, the dispenser opening 5 is provided in an upper portion of a side wall of the box 4 or in the lid 4*a* in the form of a linear slot, parallel to and at the proximity of a side edge. In view of facilitating the dispensing without, nevertheless, deteriorating the dust-protecting property of the box, the dispenser opening may, if required, be widened by means of a flap 5*a* that is foldable upwards. As the partly pulled-out abrasive material 1 closes the dispenser opening 5 relatively effectively, the dust-protecting properties of the box 4 are not deteriorated.

If the abrasive material 1 sheets or disks in the connected unit overlap each other on dispensing, the box 4 may be provided with a perforation 5*b* of the shape of an arc of a circle starting from the ends of the dispenser opening 5, so that, after tearing-off along the perforation, the dispenser opening 5 receives the form of a segment of a circle. Owing to such an arrangement, the following abrasive material sheet or disk 1 does not have to be pulled out of the box 4 on dispensing in the direction of arrow 20 (FIG. 1), which would be otherwise required by their mutual overlapping.

According to another embodiment, the dispenser opening 5 is provided at the upper side edge of one of the vertical side walls of the box 4, whereat, immediately underneath the dispenser opening 5, the side wall has an inwardly directed edge 6, whose function is to prevent the coming of more than one, the topmost abrasive material sheet or disk 1 in the bundle 3 at one time through the dispenser opening 5. A package of such a type is particularly well suitable, e.g., at a working site where a number of different coarsenesses of abrasive material are used constantly. When the dispenser opening 5 is provided in a vertical side wall, it is, viz., favourably possible to have several boxes of abrasive material of different coarsenesses piled one above the other, whereby the abrasive material is equally easily dispensable from each of the boxes.

In order that the adhesive layer on the portion, projecting out of the dispenser opening 5, of the sheet or disk of abrasive material 1 that is going to be dispensed next should not be destroyed by dust or equivalent, the carrying band 2 is favourably dimensioned wide enough so that it covers at least the main part of the projecting portion. Thus, the degree of overlapping of the individual sheets or disks of abrasive material 1, to a certain extent, determines the choice of the width of the carrying band 2, in particular when abrasive disks of circular form are concerned. As was already stated above, the carrying band may be favourably made of siliconized paper or of a plastic film, such as polypropylene, or equivalent, depending on the requirements of strength that are imposed on the carrying band 2.

If sheets or discs of self-adhesive abrasive material 1 are fixed on the carrying band 2 with a very little degree of overlapping only, the carrying band 2 may also consist of a thread. In such a case, viz., the protecting effect of the carrying band is not needed for the adhesive layer on the abrasive material, because only a very little part thereof projects.

I claim:

1. A self adhesive abrasive material packaging arrangement, comprising: a plurality of self adhesive abrasive elements, each abrasive element having an abrasive-coated face and an opposite abrasive free side; a carrying band, said plurality of self adhesive abrasive elements forming a bundle, said carrying band passing along one side of said bundle in loops between each abrasive element, an upper portion of each loop being fixed to the abrasive-free side of the corresponding abrasive element positioned above said each loop and a lower portion of each loop lying free between said upper portion of each loop and the abrasive-coated face of a corresponding abrasive-coated element of said bundle, lying below said each loop; and, a box having walls surrounding said bundle, said box having an upper opening adjacent and substantially parallel to a side edge of said bundle, said box having a substantially horizontal edge portion adjacent said opening, said edge portion projecting inwardly from a vertical side wall of said box adjacent said carrying band on said one side of said bundle, said edge portion preventing more than the uppermost abrasive element from being dispensed at one time.

2. A packaging arrangement according to claim 1, wherein said upper opening is provided in an upper lid portion of said box.

3. A packaging arrangement according to claim 1, wherein said upper opening may be widened by means of an upwardly foldable flap portion.

4. A packaging arrangement according to claim 2, wherein said lid portion is provided with a perforation having the shape of an arc of a circle, interconnecting the ends of said upper opening.

5. A packaging arrangement according to claim 1, wherein said dispenser opening is provided adjacent an upper side edge of a vertical side wall of said box, said horizontal edge bering positioned adjacent and immediately below said opening.

* * * * *